US005342112A

United States Patent [19]

Padovan

[11] Patent Number: 5,342,112

[45] Date of Patent: Aug. 30, 1994

[54] ASSEMBLY FOR A CHAIR WITH ADJUSTABLE SEAT BACK AND LEG-REST

[76] Inventor: Alessandro Padovan, Via Fratte 61, 33082 Azzano Decimo (PN), Italy

[21] Appl. No.: 27,475

[22] Filed: Mar. 8, 1993

[30] Foreign Application Priority Data

Mar. 24, 1992 [IT] Italy ..... 92A000044

[51] Int. Cl.[5] ..... B60N 2/02

[52] U.S. Cl. ..... 297/362.13; 297/423.26

[58] Field of Search ..... 297/362.13, 423.26, 297/423.3, 423.31, 423.32

[56] References Cited

U.S. PATENT DOCUMENTS

| | | | |
|---|---|---|---|
| 3,858,938 | 1/1975 | Kristensson et al. | 297/423.26 X |
| 4,819,987 | 4/1989 | Stringer | 297/423.31 X |
| 4,945,582 | 8/1990 | Hayton et al. | 297/423.26 X |

FOREIGN PATENT DOCUMENTS

| | | | |
|---|---|---|---|
| 3016839 | 11/1981 | Fed. Rep. of Germany | 297/362.13 |
| 2158350 | 11/1985 | United Kingdom | 297/423.32 |

*Primary Examiner*—Laurie K. Cranmer
*Attorney, Agent, or Firm*—Antonelli, Terry, Stout & Kraus

[57] ABSTRACT

Assembly for a chair with adjustable seat back and leg-rest, which comprises a seat frame (14) secured at its two ends by hinges (12) to a seat back frame (13) and to a leg-rest frame (15) , these three frames (13–14–15) including in their lower portions connecting struts (**16–25*a*–25*b*) positioned between one side and the other of the frames (13–14–15), the seat frame (14) comprising in its lower portion at least two reinforcing cross members (11) having the functions of resting on and being fastened to a basic characterizing structure (17) , the connecting strut (16) of the seat frame (14) bearing one single actuation means (18) that includes an actuation lever (21) which has a first inactive position and second (21*a*) and third (21*b*) positions to alter inclination, the second and third positions (21*a*–21*b*) to alter inclination cooperating with respective valves (23) which act on positioner jacks (20*a*–20*b*) located between the respective connecting struts (16–25*a*–25*b***).

4 Claims, 1 Drawing Sheet

ASSEMBLY FOR A CHAIR WITH ADJUSTABLE SEAT BACK AND LEG-REST

BACKGROUND OF THE INVENTION

This invention concerns an assembly for a chair with adjustable seat back and leg-rest.

The assembly for a chair according to this invention can be fitted mainly to various supports so as to obtain various aesthetic and useful shapes.

The chairs which can be made with the assembly of this invention are used for the relaxation and rest of their user since they enable the seat back and leg-rest to be adjusted to suit the user's requirements.

The chair can be used in the house, office, conference rooms and shops for health, sporting or recreational activities, etc.

The state of the art includes chairs with adjustable elements, and these elements consist of a seat back, a seat and a leg-rest which cooperate with each other.

A chair is known in which the leg-rest is positioned automatically at the same time as the seat back is positioned, but in this case the user, when he changes the position of the seat back, actuates of necessity the leg-rest at the same time even though the actuation of the leg-rest may not be desired or does not coincide with an actual position of greater comfort.

The state of the art covers also a chair which enables the seat back or leg-rest to be repositioned; first of all the seat back or leg-rest is brought to the end of its travel and is then repositioned in the desired position.

In this case the chair entails the drawback that the user has to raise himself from the chair so as to reposition the seat back or leg-rest.

SUMMARY OF THE INVENTION

So as to overcome the shortcomings of the state of the art and to achieve further advantages, the present applicant has designed, tested and embodied this invention.

This invention is set forth and characterized in the main claim, while the dependent claims describe variants of the idea of the embodiment.

The purpose of this invention is to provide a chair with a very simple, reliable and inexpensive assembly which can be fitted to different characterizing structures.

The invention is also suitable to enable the position of the seat back and leg-rest to be adjusted easily and independently to suit the requirements of the user without the latter having to rise from the chair or to move in relation thereto.

A further purpose of the invention is to provide a chair with an entire assembly forming a completing part of the positioning and adjusting elements so that this assembly can be fitted to a very wide range of bearing structures which characterise a chair and are, in fact, independent.

The assembly for a chair according to this invention comprises a supporting frame which constitutes the seat.

A seat back at one end and a leg-rest at the other end are secured to the seat and are fastened thereto with hinges which enable the seat back and leg-rest to rotate substantially on the same plane in relation to the seat.

The assembly according to this invention enables the positions of the seat back and leg-rest to be adjusted one at a time and independently by means of one single actuation means located in a position below the seat and easy to reach by a user placed on the chair.

The actuation means consists of a lever which has a first inactive position and second and third positions to alter inclination.

In these positions to alter inclination the lever acts on one or the other of at least two positioner jacks able to carry out continuous positioning between one position with their piston rods fully extended and another position with their piston rods fully retracted.

The jacks comprise a valve which puts a frontal chamber of the jack in communication with a chamber at the rear of the piston, thus enabling the fluid therein to flow in relation either to the axial thrust acting on the piston rod or to the excessive thrust acting on the piston.

The jacks are provided with independent thrust means which, when the valve is open, take the piston rod to its position of maximum extension or maximum retraction, depending on how the independent thrust means work.

The jacks are of a known type and may have their valve coaxial with the piston rod or separate, or the valve may be an integral part of the head, tail or body of the cylinder. In the example which follows we shall deal with a jack having its valve coaxial with the piston rod.

In the case of jacks having a valve coaxial with the piston rod, the rod of each jack is fastened to the actuation means or lever, while the bodies of the jacks are fitted to the seat back and leg-rest respectively.

The assembly for a chair is characterised in this example by an inactive position of the seat back and leg-rest in which the piston rods are in their state of maximum extension.

When the valve is open, it is possible, according to the pressure exerted by the user with his back or the lower part of his legs respectively, to adjust the inclination of the seat back or leg-rest to the required position by bringing under compression or releasing the jack in question.

When the lever is released, the valve closes and the jack keeps the seat back or leg-rest in the desired position owing to the equilibrium reached between the chambers in front of and at the rear of the piston.

The assembly for a chair according to the invention arranges that the jack acting on the seat back and leg-rest are positioned in such a way that the respective actuation elements can be operated one at a time and independently by moving the one single lever in one direction or another.

The jacks comprise advantageously means to regulate resilient reaction.

The supporting frame and also the seat back and leg-rest are finished in the usual manner, for instance with coverings, upholstery, etc.

The supporting frame is provided with positioning and fastening means, which enable the assembly for a chair according to the invention to cooperate with a base structure, which may generally have any shape or size.

In this document we have spoken of an assembly for a chair, but the concept can be applied also to divans.

BRIEF DESCRIPTION OF THE DRAWINGS

The attached figures, which are given as a non-restrictive example, show a preferred embodiment of the invention as follows.

DETAILED DESCRIPTION OF THE PREFERRED EMBODIMENTS

In the figures the reference number 10 indicates an assembly for a chair with an adjustable seat back and leg-rest according to the invention.

Figure 1:
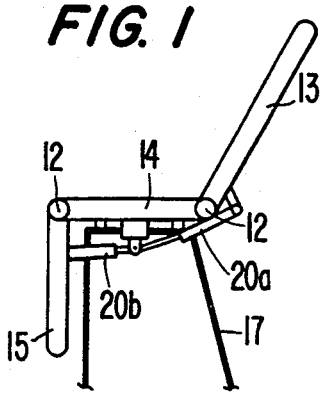
FIG. 1 is a diagrammatic side view of a chair made by using an assembly according to the invention.
Figure 2:
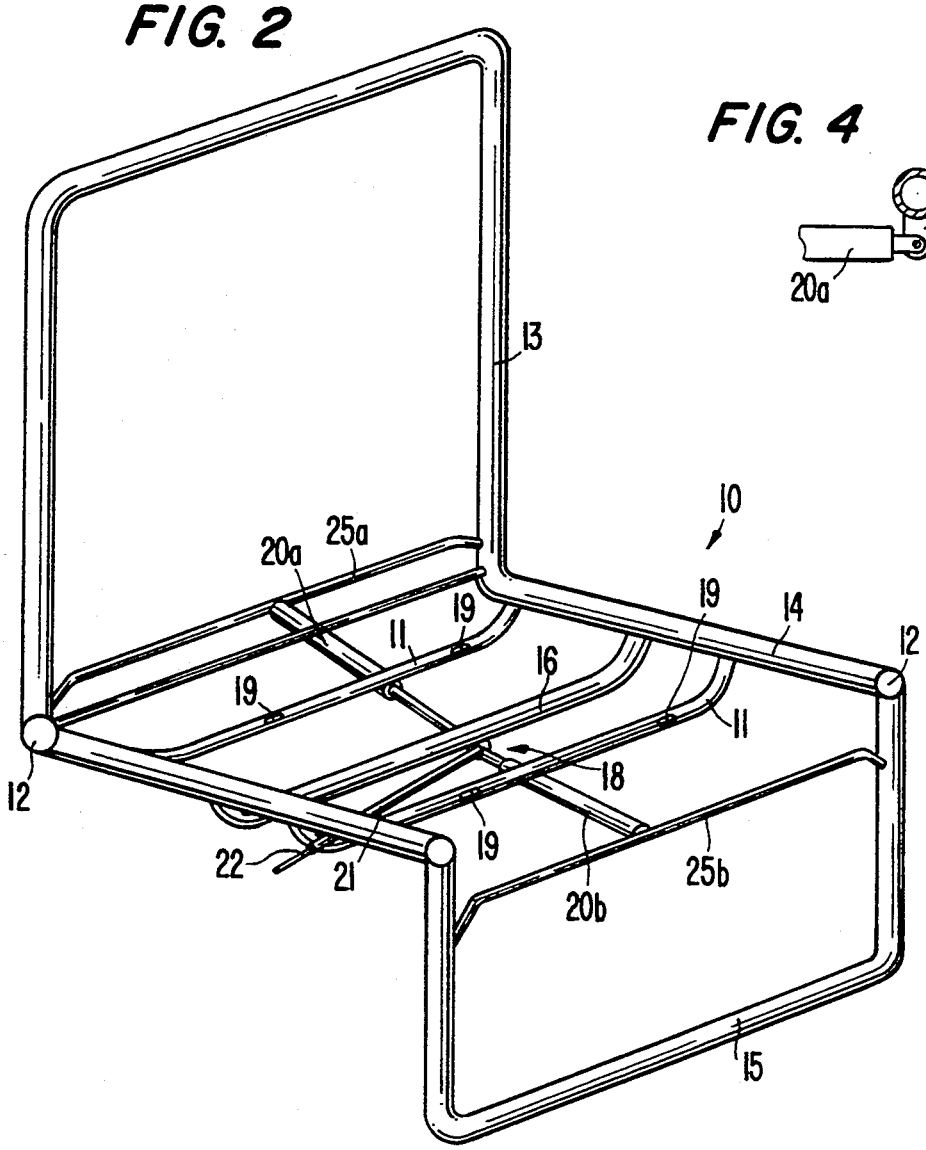
FIG. 2 is a three-dimensional view of the assembly for a chair according to the invention.

The assembly 10 for a chair is fitted as shown in FIG. 1 to a carrying structure 17 so as to form a chair. The carrying structure 17 is secured firmly to the assembly 10 by means of bolts cooperating with seatings 19 included in cross members 11 of the frame (see FIG. 2) constituting a seat 14.

To this seat 14 are connected by hinges 12 an upwardly positioned seat back 13 and a downwardly positioned leg-rest 15.

The hinges 12 enable the seat back 13 and leg-rest 15 to rotate in relation to the seat 14.

As we said above, the seat 14, so as to cooperate with the carrying structure 17, is equipped with at least two reinforcing cross members 11 (see FIG. 2) containing through holes 19 for connection to any such carrying structure 17 by means of bolts, screws, pins or other means suitable for the purpose.

Figure 3:
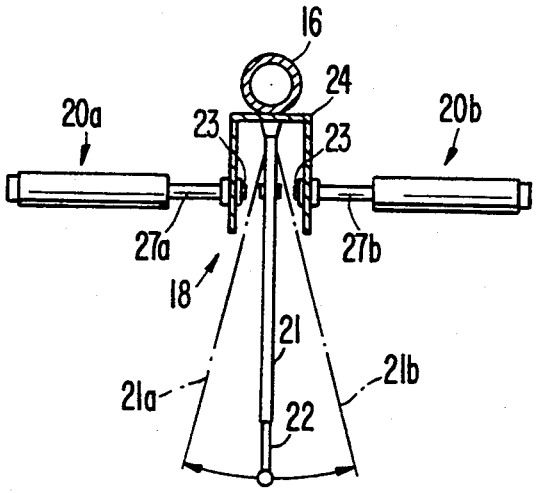
FIG. 3 shows the actuation means of the assembly of FIG. 2.

The assembly 10 comprises also a strut 16, which is provided on its lower side with an actuation means 18 and comprises a casing 24 (see FIG. 3) to which are fitted an actuation lever 21 and elements 20 to adjust and position the seat back 13 and leg-rest 15 in relation to the seat 14. The lever 21 is equipped advantageously with a hand grip 22.

The elements 20 to adjust and position the seat back 13 and leg-rest 15 in relation to the seat 14 consist of appropriate fluid-operated first and second jacks 20, which are advantageously of a pneumatic type.

In particular, in this case the first jack **20*a* acts on the seat back 13, while the second jack 20*b* acts on the leg-rest 15**.

The jacks **20*a* and 20*b* are hinged on relative struts 25*a* and 25*b* solidly fixed respectively to the seat back 13 and leg-rest 15 so as to convert the linear thrust exerted by each jack 20 into rotation of the seat back 13 or leg-rest 15** affected.

Figure 4:
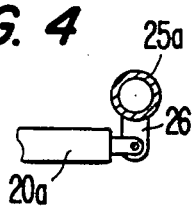
FIG. 4 shows a possible connection of the jack.

A possible embodiment is shown in FIG. 4, wherein a hinge 26 is employed to connect the first jack **20*a* to the relative strut 25*a***.

The jacks 20 are actuated independently one at a time by the lever 21, the hand grip 22 of which is located in a lateral position which can be readily reached by the user without having to rise or move from the chair.

Movement of the lever 21 from a first inactive position to a second **21*a* or third 21*b* position (see FIG. 3) converts the respective jack 20 from a condition with its piston rod 27 fully extended to a condition with its piston rod 27** fully retracted.

In fact, the lever 21 acts on valves 23, which in this example are coaxial with the piston rods 27, thus causing the opening of the valves 23, which allow the fluid inside the jacks 20 to flow.

In this way by exerting pressure on the seat back 13 or leg-rest 15 it is possible to bring under compression the respective jacks **20*a* or 20*b* and thus to position the seat back 13 or leg-rest 15** as desired.

When the desired position is reached, the release of the lever 21 causes closure of the valve inside the jack 20, and the desired position is rigidly maintained owing to the equilibrium achieved between the pressures in the frontal and rear chambers respectively of the jack 20.

When there is no pressure acting against the seat back 13 or leg-rest 15, by re-opening the valve the piston rod 27 of the jack 20 in question is thrust to its position of maximum extension, which corresponds to the inactive position of the seat back 13 and leg-rest 15.

The assembly for a chair according to the invention can be fitted to carrying structures 17 of any shape and size so as to make possible the aesthetic and functional features of the chair thus made.

I claim:

1. An assembly for a chair with adjustable seat back and leg rest comprising:

a seat frame comprising at its lower portion at least two reinforcing cross members adapted to rest on and be fastened to a basic carrying structure, said seat frame including a first connecting strut extending between first and second sides of said seat frame;

a seat back frame connected to a fist end of said seat frame by a hinge thereby enabling said seat back frame to rotate in relation to said seat frame, said seat back frame including a second connecting strut extending between first and second sides of said seat back frame;

a leg-rest frame connected to a second end of said seat frame by a hinge thereby enabling said leg-rest frame to rotate in relation to said seat frame said leg-rest frame including a third connecting strut extending between first and second sides of said leg-rest frame;

a first positioner jack including a first valve for controlling extension of said first positioner jack, said first valve being provided on an actuation device and said first positioner jack being provided between said first connecting strut and said second connecting strut;

a second positioner jack including a second valve for controlling extension of said second positioner jack, said second valve being provided on said actuation device and said second positioner jack being provided between said first connecting strut and said third connecting strut; and an actuation lever provided on said actuation device, said actuation lever being movable between a first inactive position and second and third positions respectively cooperating with said first and second valves for altering inclination of said seat back frame and said leg-rest frame with respect to said seat frame.

2. Assembly as claimed in claim 5, in which the reinforcing cross members contain holes through which can be provided means for connection of the assembly to the basic carrying structure.

3. Assembly as claimed in claim 5, in which the first and second positioner jacks are fluid-operated jacks with independent resilient actuation means for extending and fully retracting the jacks.

4. Assembly as claimed in claim 5, in which the first and second valves of the first and second positioner jacks are coaxial with piston rods of the jacks.

* * * * *